US008056771B2

(12) United States Patent
Rossignol

(10) Patent No.: US 8,056,771 B2
(45) Date of Patent: Nov. 15, 2011

(54) PUMP TRIGGERING AND DISPENSING HEAD

(75) Inventor: Eric Rossignol, Chalon sur Saone (FR)

(73) Assignee: Rexam Dispensing SMT S.A. (FR)

( * ) Notice: Subject to any disclaimer, the term of this patent is extended or adjusted under 35 U.S.C. 154(b) by 658 days.

(21) Appl. No.: 12/122,306

(22) Filed: May 16, 2008

(65) Prior Publication Data

US 2008/0277429 A1 Nov. 13, 2008

Related U.S. Application Data

(63) Continuation of application No. PCT/FR2006/002478, filed on Nov. 7, 2006.

(30) Foreign Application Priority Data

Nov. 16, 2005 (FR) ..... 05 53478

(51) Int. Cl.
*B65D 88/54* (2006.01)

(52) U.S. Cl. ..... 222/321.3; 222/321.7; 222/321.9; 222/322; 222/380; 222/402.25; 222/501; 222/518

(58) Field of Classification Search ..... 222/321.7, 222/380, 321.9, 340, 321.3, 321.1, 321.8, 222/383.1, 321.2, 322, 501, 518, 402.25; 239/333, 473, 570, 583, 337, 353
See application file for complete search history.

(56) References Cited

U.S. PATENT DOCUMENTS

| | | | | |
|---|---|---|---|---|
| 3,268,123 | A | 8/1966 | Spatz | |
| 4,088,248 | A * | 5/1978 | Blake | 222/207 |
| 4,494,680 | A * | 1/1985 | Corsette | 222/321.3 |
| 4,830,284 | A * | 5/1989 | Maerte | 239/333 |
| 5,085,353 | A * | 2/1992 | Inui et al. | 222/402.13 |
| 5,195,665 | A * | 3/1993 | Lina | 222/496 |
| 5,205,443 | A * | 4/1993 | Inui et al. | 222/402.13 |
| 5,348,189 | A * | 9/1994 | Cater | 222/1 |
| 5,373,971 | A | 12/1994 | Laffy et al. | |
| 5,429,275 | A * | 7/1995 | Katz | 222/108 |
| 5,458,289 | A * | 10/1995 | Cater | 239/119 |
| 5,511,698 | A | 4/1996 | Solignac | |
| 5,657,930 | A * | 8/1997 | Battegazzore | 239/333 |
| 5,842,616 | A * | 12/1998 | Ruscitti et al. | 222/321.3 |
| 6,161,732 | A * | 12/2000 | Albini | 222/321.3 |
| 6,460,739 | B1 * | 10/2002 | Norris et al. | 222/380 |
| 6,763,978 | B2 * | 7/2004 | Pritchett et al. | 222/321.7 |
| 6,966,465 | B2 * | 11/2005 | Kang, III | 222/321.9 |
| 7,048,155 | B2 * | 5/2006 | Kuwahara et al. | 222/321.9 |
| 7,780,045 | B2 * | 8/2010 | Rossignol | 222/322 |
| 2006/0186139 | A1 * | 8/2006 | Laidler et al. | 222/207 |

FOREIGN PATENT DOCUMENTS

DE 3038917 A1 5/1982

OTHER PUBLICATIONS

International Search Report, Mar. 26, 2007, 2 pages.

* cited by examiner

*Primary Examiner* — Frederick C. Nicolas

(74) *Attorney, Agent, or Firm* — St. Onge Steward Johnston & Reens LLC

(57) ABSTRACT

A triggering and dispensing head to be mounted on a pump for a liquid product dispenser provided with an exhaust conduit wherein the head has a body provided with an ejection channel closable by a flap which has a center punch translationally displaceable in the channel and hingeable about a drive billet connected to an axial rod sliding in the exhaust conduit.

14 Claims, 3 Drawing Sheets

PUMP TRIGGERING AND DISPENSING HEAD

CROSS-REFERENCE TO RELATED APPLICATIONS

The present application is a continuation of pending International patent application PCT/FR2006/002478 filed on Nov. 7, 2006 which designates the United States and claims priority from French patent application 0553478 filed on Nov. 16, 2005, the content of which is incorporated herein by reference.

FIELD OF THE INVENTION

The present invention concerns an actuation and dispensing head intended to equip a pump and more particularly a pump for a dispenser of liquid products such as cosmetics, perfumes or medicines.

BACKGROUND OF THE INVENTION

Traditional dispensers encounter problems of sealing in particular as regards the pump chamber which contains the measures of product to be delivered.

This chamber opens to the outside via an outlet duct extended by an ejection channel provided in the pump actuation head and which is generally closed off by a so-called end check valve.

Another problem lies in the incompatibility of certain products with metals which prohibits any contact with the pump return spring.

Furthermore, the dispensing method is often poorly controlled which is detrimental to the measuring out of the product in particular when the volumes to be delivered are small (a few tens of microliters).

Moreover, there are difficulties in manufacture and assembly of the various constituent parts of the dispenser.

This problem arises, in particular, for the elements of the pump contributing towards sealing whereof the fineness and positioning are a determining factor for the production of a reliable and efficient dispenser, and for the constituent elements of the head which comprise principally a body in which the final ejection channel for the product is provided.

The aim of the present invention is to satisfactorily solve the problems posed by the prior art by providing sealing means additional to those of the dispenser at the level of the ejection duct of the pump actuation head.

SUMMARY OF THE INVENTION

This objective is achieved, according to the invention, by means of a head where said valve comprises a sealing needle movable translationally in said channel and articulated on a drive link connected to an axial rod sliding in said pump outlet duct.

According to an advantageous characteristic, said needle is articulated on said link by means of a deformable connecting band.

According to another characteristic, said link is connected laterally to said body by a hinge.

According to yet another characteristic, said needle is secured laterally by a set of elastic strips whereof the free ends are fixed to the body.

According to a first variant, said link consists of a cam with triangular cross-section articulated by its corner on a bevelled part of the needle.

According to another variant, said head moreover comprises a cover topping said body and closing said ejection channel in the upper part.

Preferably, said cover comprises a lateral aperture delimiting the end of said channel and whereof the internal circumference is capable of receiving the sealed pressing of the needle in the closing-off position.

Advantageously, said channel is provided with deformable upper lips allowing the latching of the needle.

According to a first variant, said link is extended by a transmission element consisting of a radial tab resting, without coupling, on the upper end of said rod.

According to an alternative variant, said rod is, this time, coupled to said link via a transmission element that is at least partially deformable.

In this case, said rod can be made in a single piece with the body and the link or else in the form of an added-on piece and said transmission element then comprises a coupling member cooperating by locking with an anchoring member disposed at the upper end of said rod.

According to another characteristic, said rod is provided with a lateral lug cooperating with a retaining notch provided on the internal wall of the outlet duct.

According to a specific variant, said rod has a diameter substantially equal to the internal diameter of the outlet duct, delimiting with the wall thereof a longitudinal passage for the product.

By virtue of its retractable needle, the head of the invention provides automatic sealing of the dispenser.

The sealing is, moreover, reinforced and made secure by the action of the elastic strips which, in the rest position of the head, provide the forced pressing of the needle against the output aperture of the ejection channel.

As for the link and the rod, these make it possible to split the product dispensing method that takes place in this way into two times which allows better control of the measuring out.

Moreover, the body of the head can be made in a single piece by injection moulding.

Finally, this head provides a high rate of retrieval of the product.

BRIEF DESCRIPTION OF THE DRAWINGS

Other objects and advantages of the invention will emerge in the course of the following description, given with reference to the accompanying drawings, in which.

DETAILED DESCRIPTION OF THE INVENTION

The head of the invention forms a pushbutton intended to equip a pump P for a dispenser of liquid products.

This head is therefore intended to cooperate with the mechanism of the pump P and in particular the return spring S which is depicted in FIGS. 2A to 2D and the following ones, and the outlet duct E sometimes made in the form of a tube referred to as a nozzle.

Figure 1A:
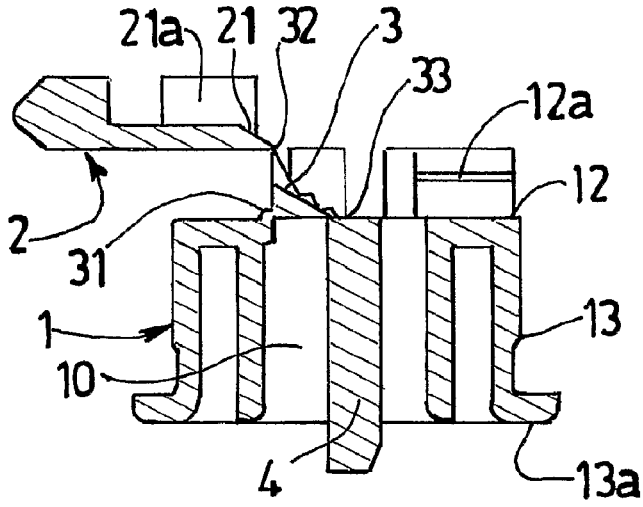
FIGS. 1A to 1C depict partial views of one embodiment of the head of the invention, respectively in axial section of the body before mounting, in a view from above of the body with a horizontal section of the cover and in a view from below of the body before mounting and without the cover.
Figure 1B:
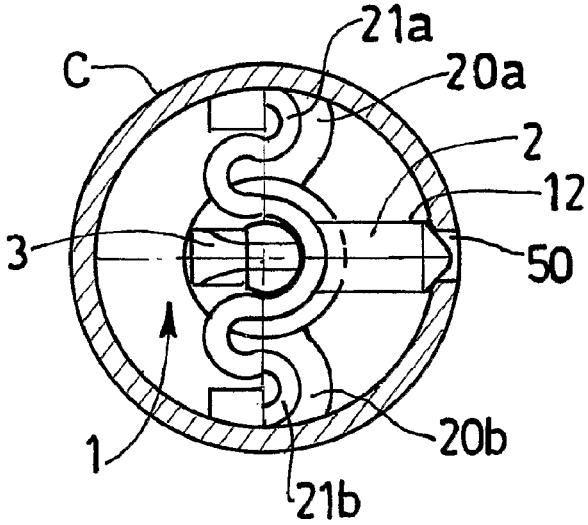
Figure 1C:
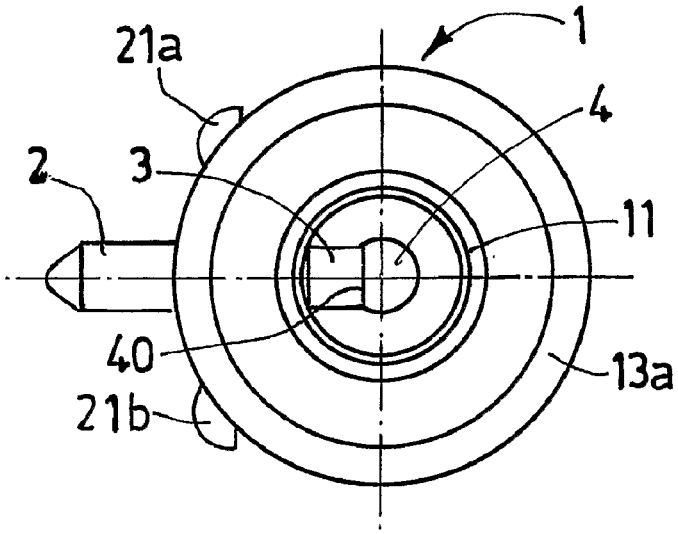

The head of the invention, as depicted in particular in FIGS. 1A to 1C, comprises a cylindrical body 1 supporting a closing-off needle 2 forming a valve for the product output aperture and a cover or cap C (FIG. 2A) topping and covering said body.

If applicable, in order to reinforce the sealing, the internal circumference of the output aperture will be provided with an annular ring (not depicted) forming a valve seat for the end of the needle 2.

The cover C is, for example, latched or fitted on the body 1 (as in the variant depicted here in the figures).

As depicted in FIG. 1B, the needle 2 is intended to fit into a discharge channel 12 provided here on the upper face of the body 1 after lowering and latching from the deployed mould output position of FIG. 1A, the device being made here in a single piece.

The channel 12 has, in its upper part, radially projecting deformable lips 12*a* which partially close up the channel and hold the needle 2 in its housing whilst the cover C comes to close the upper part of the channel 12.

The cover C comprises a lateral aperture delimiting the end of the channel 12 and the boundaries of its output aperture 50 whereof the internal circumference is capable of receiving the sealed pressing of the needle 2 in the closing-off position.

In the operating position (FIG. 1B), the needle 2 is retractable translationally into the channel 12, by manual pressure on the cover C topping the body 1 and joint compression of the spring S (see FIGS. 2A to 2D).

Figure 2A:
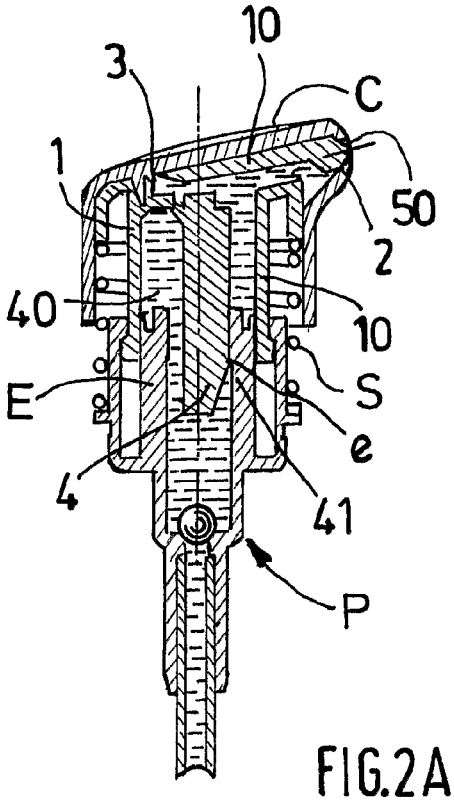
FIGS. 2A to 2D depict sectional views of a pump equipped with a variant of the head of the invention in various positions.
Figure 2B:
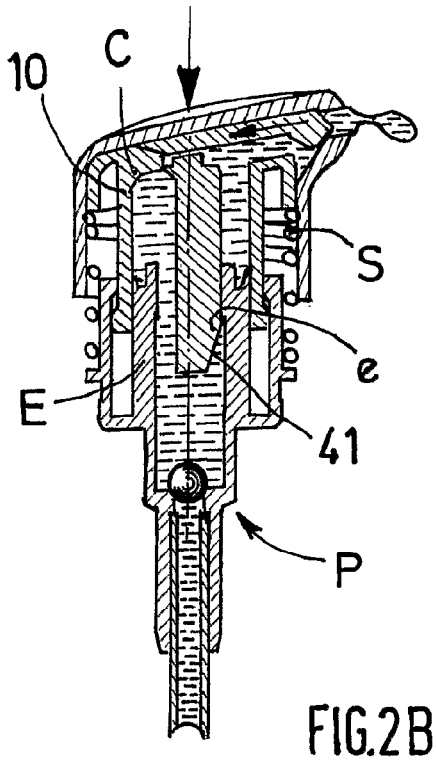

To that end, the needle 2 is articulated on a drive link 3 connected to an axial guide rod 4 which is cable of sliding, in the manner of a piston, in the outlet duct E of the pump P during dispensing of the product (see FIG. 2B).

The link 3 consists of a cam with triangular cross-section connected by its corners, in the central bottom part, to the rod 4 via a transmission element 33, and, in the lateral bottom part, to the body 1 via an elastic hinge 31.

In the top part, the link 3 is articulated on a bevelled end 21 of the needle 2 via a deformable connecting band 32. The link 3 thus has an axis of pivot with each adjacent element.

The thin connecting band 32 allows in particular the lowering of the needle 2 into the position of FIG. 1B from the position of FIG. 1A which corresponds to the output from the manufacturing mould.

The rod 4 is inserted with freedom to slide in the duct E and has a longitudinal flat section 40 (see FIGS. 2A to 2D and 3) or a longitudinal groove (not depicted) allowing the passage of the product through said duct and in the direction of the channel 12 since the rod 4 has here a diameter substantially equal to the internal diameter of the outlet duct E.

The rod 4 is also provided with a lateral lug 41 cooperating with a retaining notch e provided on the internal wall of the duct E.

During mounting of the body 1 on the pump P, the rod 4 enters the duct E and the lug 41 comes to latch under the notch e.

The duct E communicates with the channel 12 via a measuring-out chamber 10 delimited inside the body 1 and extending coaxially with said duct.

In order to perfect the sealing of the chamber 10 forming the piston cylinder, the upper edge of the duct E will advantageously be provided with a peripheral lip L (FIGS. 2C, 2D and 3) in dynamic contact with the wall of the body 1.

The needle 2 is secured laterally to a set of two elastic strips 21*a*, 21*b* whereof the free ends are fixed to the body 1 by clamping in slots 20*a*, 20*b*, after lowering of the needle (see FIG. 1B). The strips 21*a*, 21*b* contribute towards the return, guidance and then holding of the needle in the position of closing off the channel 12.

In the embodiments of FIGS. 1A, 2A, 3 and 4, the rod 4 is coupled to the link 3 via a transmission element 33 that is at least partially deformable.

In the variants of FIGS. 1A and 2A, the rod 4 is moreover made in a single piece with the body 1 and the link 3.

Figure 5:
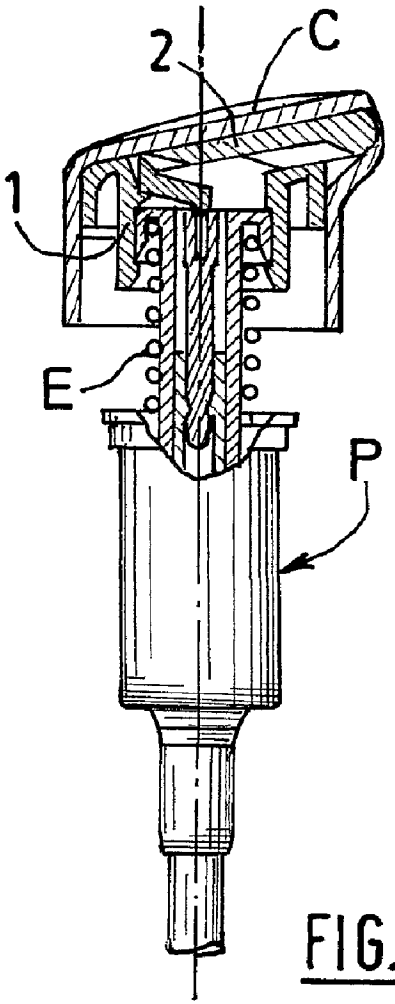
FIGS. 3, 4 and 5 depict sectional views of a pump equipped respectively with three other variant embodiments of the head of the invention.
Figure 4:
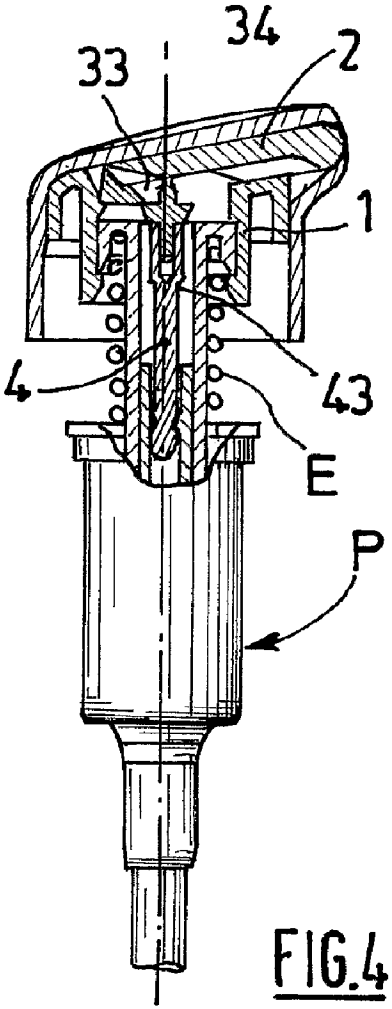
Figure 3:
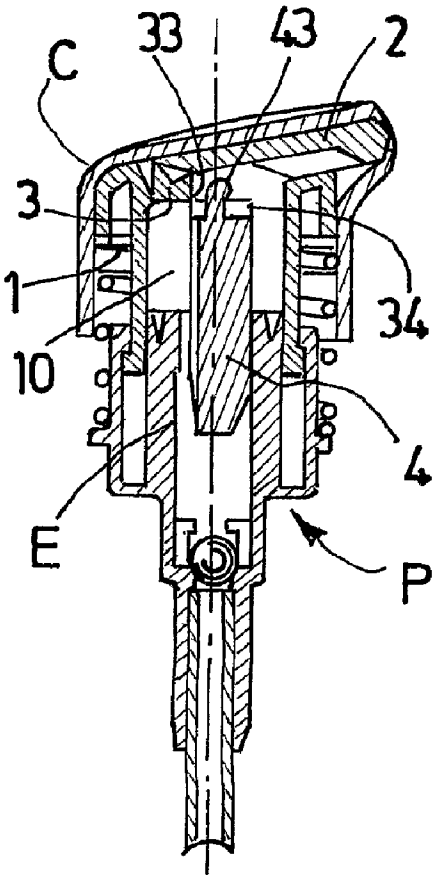

On the other hand, in the variants of FIGS. 3 and 4, the rod 4 is made in the form of an added-on piece and, in the specific variant of FIG. 5, the link 3 is extended by a transmission element 33 consisting of a radial tab resting, in this case by contact and without coupling, on the upper end of the rod 4.

In FIGS. 3 and 4, the transmission element 33 comprises a specific coupling member 34 cooperating by locking with an anchoring member 43 disposed at the upper end of the rod 4.

In FIG. 3, the coupling member 34 consists of a flexible washer through which the anchoring member in the form of a lug secured to the rod 4 is forcibly introduced.

In FIG. 4, the coupling member 34 consists of a lug forcibly introduced into the anchoring member formed from a cavity provided at the top of the rod 4.

The operation of the head will now be described with reference to FIGS. 2A to 2D where the liquid product appears in a dark colour.

In FIG. 2A, the pump is depicted after priming and the head has therefore previously been filled with product.

Figure 2C:
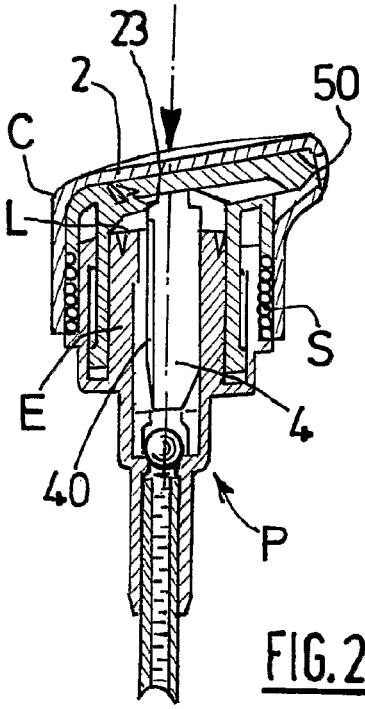
Figure 2D:
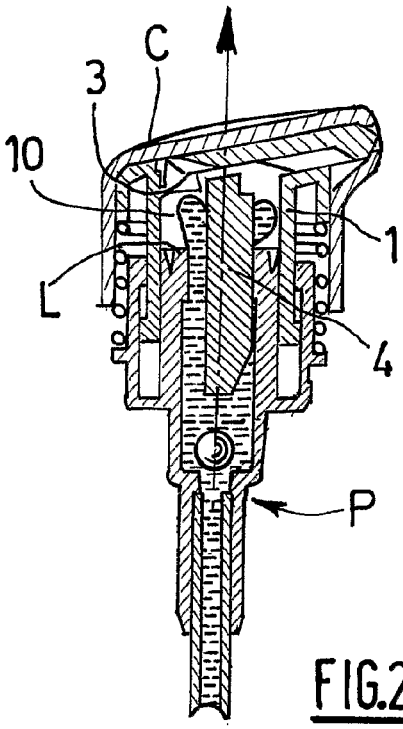

FIGS. 2C and 2D which depict the return of the head to the rest position are also applicable to the priming phase.

In the rest position depicted in FIG. 2A, the end of the needle 2 is pressed towards the front against the aperture 50 in the cover C, under the action of both the elastic strips 21*a*, 21*b* and the spring S which is under slight tension, thus hermetically closing off the channel 12 and, more generally, the pump P and the associated dispenser in its entirety.

In parallel, whilst the body 1 is pushed away upwards, the rod 4 is pulled downwards in the duct E by the retaining notch e and contributes towards the rotational torque to which the link 3 and its various articulations are subjected in the clockwise direction, thus reinforcing the action of the needle 2.

The position depicted in FIG. 2B corresponds to the start of the product dispensing phase, the head beginning its descent in response to the manual pressure exerted vertically by the consumer on the cover C as represented by the arrow.

During this phase, the rod 4 remains substantially immobile in the duct E on account of the inevitable friction accompanying its sliding fitting in the duct E.

As for the body 1, this begins its descent by compressing the spring S and subjecting the link 3 to a rotational torque in the anticlockwise direction. This movement brings about the translational movement towards the rear of the needle 2 and its retreat with respect to the ejection aperture 50.

In parallel, the measuring-out chamber 10 empties progressively through the compression effect resulting from the relative movement of body and duct in the manner of a piston and the scraping of its wall by the lip L of the duct E thus causing a start of delivery of the product via the channel 12 and the aperture 50.

The pressure on the head being maintained, the movement continues and the link 3 comes into abutment against the bevelled end 21 of the needle 2, as depicted in FIG. 2C.

Then, the upper end of the rod 4 comes into abutment against the needle 2 and the travel of the needle is then at its maximum whilst the chamber 10 continues to empty.

As a result of the continuation of the pressing forces on the head, the rod 4 starts sliding downwards in the duct E of the pump, whilst the link 3 remains in abutment against the needle 2. The measuring out ends when the bottom part of the body 1 reaches the lower shoulder of the pump P or when the upper edge of the duct E comes into abutment against the hinge 31 of the link 3 (FIG. 2C).

FIG. 2D corresponds to the phase of return of the head to the rest position of FIG. 2A.

Release of the manual pressure brings about relaxation of the spring S. This relaxation first causes ascent of the body 1 and pivoting of the link 3 in the clockwise direction until the needle 2 comes back into abutment against the aperture 50, the rod 4 remaining immobilised in the duct E.

This movement is accompanied by the intake of product into the chamber 10 here via the inlet ball valve and progressive filling of the chamber in the internal volume of the body 1.

Then the friction of the rod 4 in the duct is overcome and the rod 4 rises again until its lug 41 comes into abutment against the notch e of the duct E, the needle being held pressed against the aperture 50 by virtue of the action of the elastic strips 21*a*, 21*b*.

The spring S is then kept under slight tension by the early bringing into abutment of the facing parts of the body 1 and the duct E.

What is claimed is:

1. An actuation and dispensing head intended to equip a pump for a dispenser of liquid products provided with an outlet duct, said head comprising a body which provides an ejection channel capable of being closed off by a valve, characterised in that said valve comprises a sealing needle movable translationally in said channel and articulated on a drive link connected to an axial rod sliding in said outlet duct;

characterised in that said rod is provided with a lateral lug cooperating with a retaining notch provided on an internal wall of the outlet duct.

2. A head according to claim 1, characterised in that said needle is articulated on said link by means of a deformable connecting band.

3. A head according to claim 1, characterised in that said link consists of a cam with triangular cross-section articulated by a corner of said cam on a bevelled part of the needle.

4. A head according to claim 1, characterised in that it moreover comprises a cover topping said body and closing said ejection channel in an upper part of said ejection channel.

5. A head according to claim 4, characterised in that said cover comprises a lateral aperture delimiting an end of said channel and whereof the internal circumference of the lateral aperture is capable of receiving a sealed pressing of the needle.

6. A head according to claim 1, characterised in that said channel is provided with deformable upper lips allowing latching of the needle.

7. A head according to claim 1, characterised in that said rod is coupled to said link via a transmission element that is at least partially deformable.

8. A head according to claim 1, characterised in that said rod is made in a single piece with the body and the link.

9. A head according to claim 1, characterised in that said link is extended by a transmission element consisting of a radial tab resting without coupling on an upper end of said rod.

10. A head according to claim 7, characterised in that said rod is made in a form of an added-on piece and said transmission element comprises a coupling member cooperating by locking with an anchoring member disposed at the upper end of said rod.

11. A head according to claim 1, characterised in that said rod has a diameter substantially equal to the internal diameter of the outlet duct, delimiting with a wall thereof a longitudinal passage for the products.

12. A head according to claim 2, characterised in that said link is connected laterally to said body by a hinge.

13. An actuation and dispensing head intended to equip a pump for a dispenser of liquid products provided with an outlet duct, said head comprising a body which provides an ejection channel capable of being closed off by a valve, characterised in that said valve comprises a sealing needle movable translationally in said channel and articulated on a drive link connected laterally to said body by a hinge and connected to an axial rod sliding in said outlet duct.

14. An actuation and dispensing head intended to equip a pump for a dispenser of liquid products provided with an outlet duct, said head comprising a body which provides an ejection channel capable of being closed off by a valve, characterised in that said valve comprises a sealing needle secured laterally by a set of elastic strips whereof free ends of said elastic strips are fixed to the body, and wherein said needle is movable translationally in said channel and articulated on a drive link connected to an axial rod sliding in said outlet duct.

* * * * *